United States Patent [19]

Kufferath

[11] Patent Number: 5,056,565

[45] Date of Patent: Oct. 15, 1991

[54] PAPER MAKING DRAINAGE BELT WITH FUNNEL-LIKE CHANNELS

[76] Inventor: Franz F. Kufferath, Lommessemstrasse 37, 5160 Duren, Fed. Rep. of Germany

[21] Appl. No.: 408,548

[22] Filed: Sep. 18, 1989

Related U.S. Application Data

[63] Continuation-in-part of Ser. No. 57,689, Jun. 1, 1987, Pat. No. 4,867,206, which is a continuation-in-part of Ser. No. 755,807, Jul. 17, 1985, abandoned.

[30] Foreign Application Priority Data

Jul. 17, 1984 [DE] Fed. Rep. of Germany ..... 3426264

[51] Int. Cl.[5] ..... D03D 15/00

[52] U.S. Cl. ..... 139/383 A; 162/DIG. 1; 139/425 A

[58] Field of Search ..... 139/383 A, 425 A, 410, 139/413; 162/DIG. 1

[56] References Cited

U.S. PATENT DOCUMENTS

| | | | |
|---|---|---|---|
| 2,949,134 | 8/1960 | Hindle et al. | 139/383 A |
| 3,214,326 | 10/1965 | Lee . | |
| 4,356,844 | 11/1982 | Thompson | 139/383 A |
| 4,554,953 | 11/1985 | Borel et al. | 139/383 A |
| 4,564,051 | 1/1986 | Odenthal | 139/383 A |
| 4,569,375 | 2/1986 | Borel | 139/383 A |
| 4,867,206 | 9/1989 | Kufferath | 139/383 A |

FOREIGN PATENT DOCUMENTS

| | | |
|---|---|---|
| 0089032 | 9/1983 | European Pat. Off. . |
| 0141791 | 5/1985 | European Pat. Off. . |
| 1461105 | 4/1968 | Fed. Rep. of Germany . |
| 3225599 | 1/1984 | Fed. Rep. of Germany . |
| 3305713 | 4/1984 | Fed. Rep. of Germany . |

*Primary Examiner*—Andrew M. Falik
*Attorney, Agent, or Firm*—Wigman & Cohen

[57] ABSTRACT

In a drainage belt for presses in the wet section of a paper machine, which belt includes a porous support belt (3,4) in the form of a screen webbing and a finely porous cover layer (1,2) on the side of the support belt (3,4) facing the paper web, the cover layer (1,2) is formed by a shape-retaining single-plane screen webbing which forms drainage channels.

22 Claims, 6 Drawing Sheets

PAPER MAKING DRAINAGE BELT WITH FUNNEL-LIKE CHANNELS

BACKGROUND OF THE INVENTION

This application is a continuation-in-part of U.S. application Ser. No. 07/057,689, filed June 1, 1987, U.S. Pat. No. 4,867,206 which is a continuation-in-part of application Ser. No. 06/755,807, filed July 17, 1985 abandoned.

The invention relates to a drainage belt for a press in the wet section of a paper machine.

In the press section of a paper machine, the paper web lying on a drainage belt or lying between two drainage belts is guided through the nip of at least one press, which uses mechanical pressure to press out a portion of the water contained in the paper web. The purpose of the drainage belt or belts is to absorb the water pressed out of the paper web.

In order to increase the drainage capacity of a press, it is known to place a wire beneath the wet felt lying on the paper web, and to allow this screen to run through the nip as a separate element. The web felt thereby forms a finely porous covering and the wire forms a porous support belt.

In modern presses, the drainage capacity of the drainage belt formed in this manner is fully utilized, i.e., the drainage belt limits the capacity of the press. The operating speed of the paper machines, however, has not yet reached an upper limit. Furthermore, to reduce steam, and thereby save energy in the drying section, it is desirable to increase the dryness factor of the paper web as it leaves the press section. The increased performance capacity of the press section required to achieve this purpose could previously be achieved only by increasing the number of presses, which means a significant expense. This is also true with the use of a different, known drainage belt, which has a screen webbing as a support belt and a foil perforated by a laser beam as a cover layer, because even its drainage capacity does not exceed that of a drainage belt having a felt as a cover layer.

There is disclosed in the present invention a drainage belt which is comprised of three layers or systems of yarns running in the transverse direction of the belt, disposed one above the other.

SUMMARY AND OBJECTS OF THE INVENTION

It is known to a person with average skill that two layers of a drainage belt may be woven together by the yarns of one or both layers (for one of the layers see for instance FIGS. 1, 2, 3 and 5) or by additional yarns, so-called binding yarns (see for instance FIGS. 1–3, of DE 33 05 713; binding warp 5 and binding weft 8 in FIGS. 1 and 2, binding weft 9 in FIG. 3).

The object of the invention is to create a drainage belt for presses in the wet section of a paper machine, which makes it possible to increase the drainage capacity of a wet press.

A drainage belt of this type does not lose its openness under pressure in the nip. Therefore, the water absorption capacity is increased not only by the embodiment of the cover layer as a screen webbing, but also, primarily, by the fact that the water absorption capacity of the entire drainage belt can be fully utilized. One therefore need only select the open space of the drainage belt to be at least large enough that it can absorb all of the water removed from the paper web in the nip in order to increase the capacity of the press. Because the cover layer does not lose its openness in the compression nip, due to the embodiment as a shape-retaining, single-plane screen webbing which forms drainage channels, even the permeability of the drainage belt can be adjusted without difficulty, so that no critical hydraulic pressure can build up in the nip, which could lead to a destruction of the paper web. An additional advantage of the drainage belt according to the invention is that the water stored therein ca easily be removed by centrifugal force as the belt is diverted about a roller or by aspiration.

Finally, the drainage belt according to the invention also is better than the known drainage belts at preventing a remoistening of the paper web, i.e., a back flow of the water out of the drainage belt into the paper web as it leaves the compression nip.

The drainage belt according to the invention, which makes possible not only a vertical drainage flow but also a transverse drainage flow, permits a controlling of the water absorption and thereby an optimalization of the drainage capacity under different conditions, by means of the embodiment of the cover layer and the support belt as well as the cooperation of both elements.

In addition, it contributes to an improvement in the sheet formation. For example, the uniform drainage capacity over the entire width of the belt can avoid surface weight fluctuations in the paper web. Furthermore, the compressibility of the paper web is made more uniform, i.e., the characteristics of the two sides of the paper web that are material to compressibility more nearly approach each other.

A further advantage of the drainage belt according to the invention is seen in the fact that its drainage may be accomplished at a lower consumption of energy than is possible with the commonly used web felts.

To further improve the drainage capacity, the drainage channels in the cover layer can be enlarged toward the support belt. This is also advantageous with respect to having the smallest possible remoistening of the paper web. Furthermore, the permeability of the support belt for water and air, advantageously, is greater than that of the cover layer. Preferably, the permeabilities of the two layers are adjusted to each other such that they are equivalent to a funnel which opens toward the underside of the support belt opposite the cover layer.

In one preferred exemplary embodiment, the number of drainage channels in the cover layer is larger than in the support belt. It is also advantageous if the screen webbing of the cover layer is substantially less thick than that of the support belt.

The characteristics of both the cover layer and the support belt can be particularly well adapted to the given requirements if the cover layer and/or the support belt are formed in multiple layers, whereby the individual layers can have different forms.

Other advantageous embodiments of the drainage belt according to the invention are the object of additional dependent claims.

BRIEF DESCRIPTION OF THE DRAWINGS

The invention is described in greater detail below with the aid of exemplary embodiments illustrated in the unscaled drawings.

DETAILED DESCRIPTION OF PREFERRED EMBODIMENTS

Figure 1:
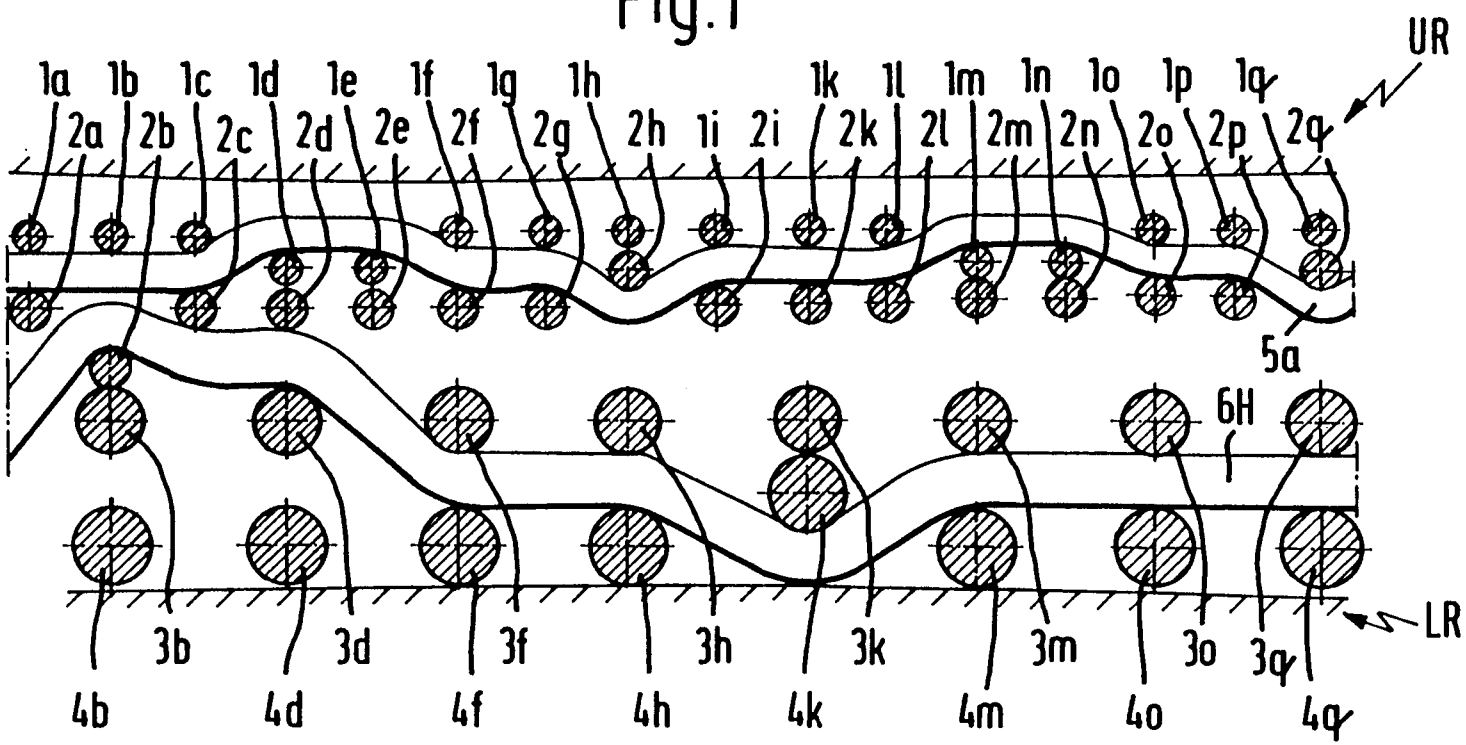
FIG. 1 is a longitudinal cross-section according to Line I—I in FIG. 4 with the press rolls added for clarity.
Figure 2:
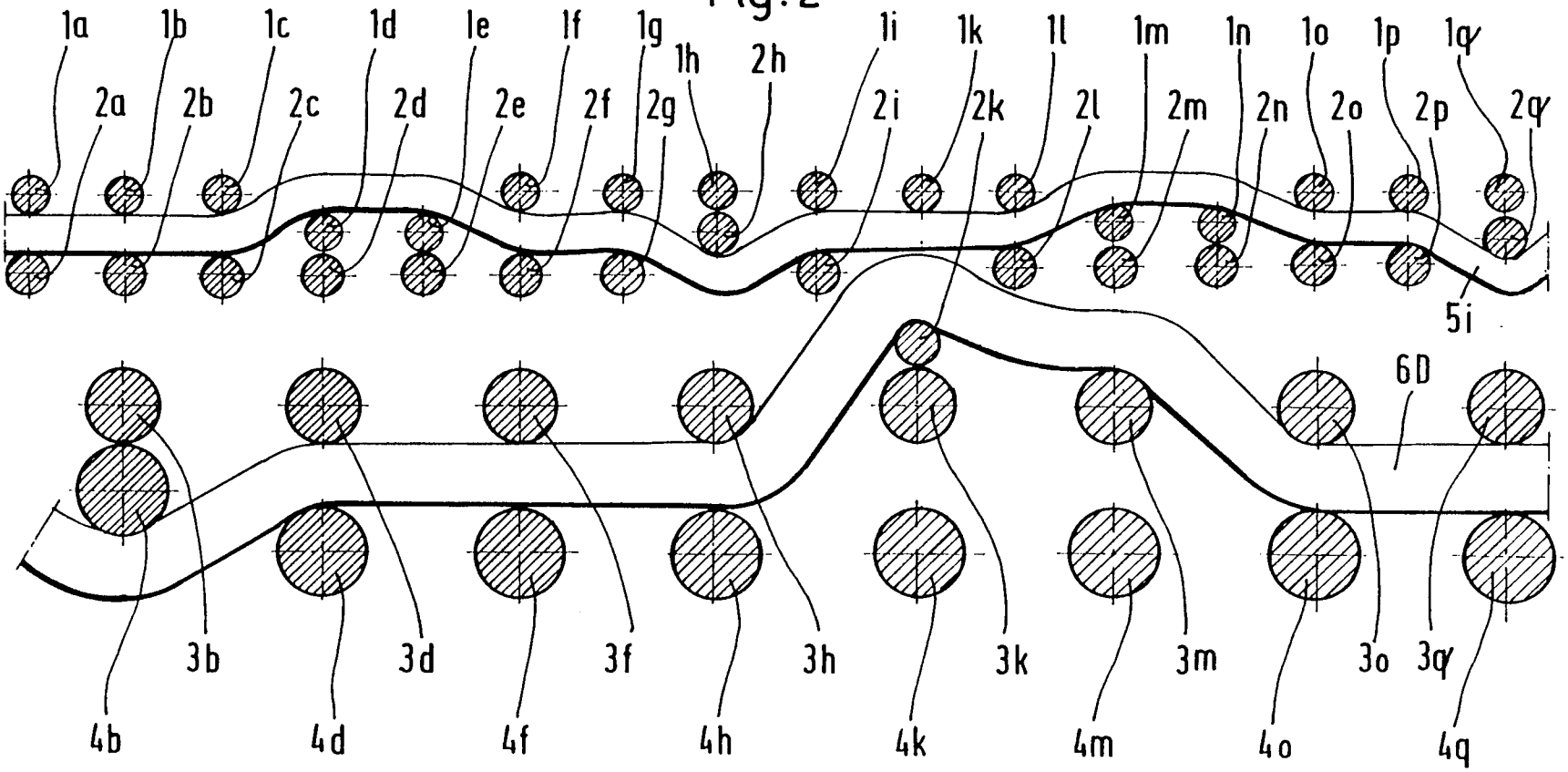
FIG. 2 is another longitudinal cross-section according to Line II—II in FIG. 4.
Figure 3:
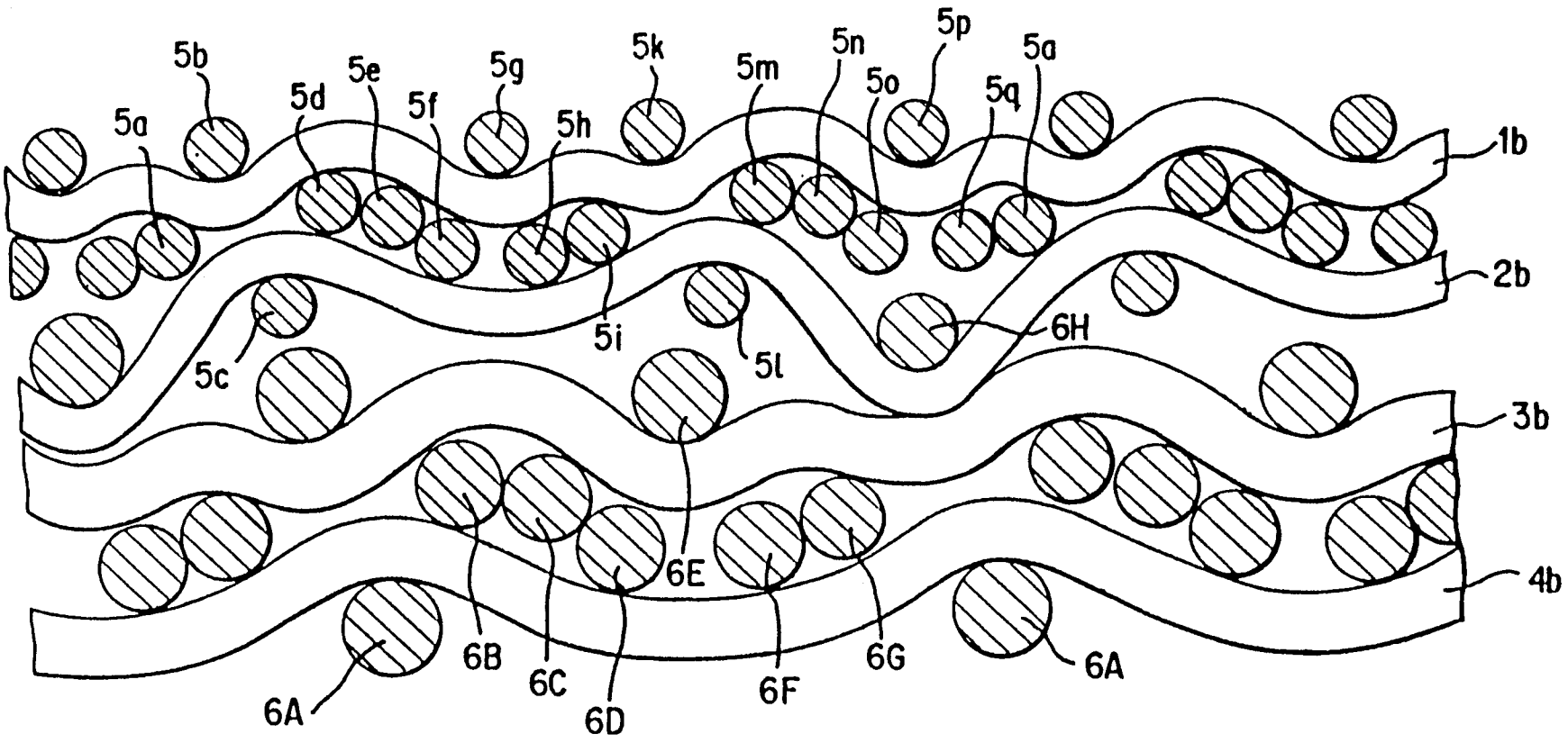
FIG. 3 is a transverse cross-section according to Line III—III in FIG. 4.

As shown in FIGS. 1-3, the drainage belt according to the first embodiment is comprised of four layers or systems of yarns running in the transverse direction of the belt. These yarns are usually the wefts. The four systems or layers of yarns are disposed one above the other. In FIGS. 1 and 2, with the belt lying in a horizontal plane, the yarns are vertically disposed with respect to one another. The uppermost layer, which comes into contact with the paper web, is designated with the numerals 1a-1q, the yarn layer lying immediately beneath the first such layer is designated with the numerals 2a-2q, the yarn layer lying beneath layer 2a-2q is designated with the numerals 3b-3q, and the bottom yarn layer, which forms the running surface of the drainage belt, is designated with the numerals 4b-4q. The uppermost yarn layer 1a-1q has 28 yarns per cm, each having a diameter of 0.15 mm. The yarns of the yarn layer 2a-2q lying immediately beneath the layer 1a-1q, have a diameter of 0.18 mm and lie precisely beneath the yarns of the uppermost layer 1a-1q. The uppermost yarn layer 1a-1q and the yarn layer 2a-2q lying thereunder, which can also be designated as the first intermediate layer, are connected with each other by a first longitudinal yarn system or warp 5a-5q, which consists of 72 longitudinal yarns having a diameter of 0.15 mm. The course of the yarns of this first longitudinal yarn system or warp 5a-5q can be seen in FIGS. 1-3 in which it is apparent that a portion of longitudinal yarn system 5a-5q, together with yarn layer 1a-1q, contacts the paper web. Two adjacent yarns of the uppermost yarn layer 1a-1q are tied in at intervals. The longitudinal yarns then run between the next two yarns of the uppermost yarn layer 1a-1q and the yarns of the layer 2a-2q aligned with said yarns of the layer 1a-1q, then tying in one yarn of the first intermediate layer 2a-2q, and then run past three yarns between the uppermost layer 1a-1q and the first intermediate layer 2a-2q. Although the diameter of the yarns of the uppermost yarn layer 1a-1q is smaller than the diameter of the yarns of the first intermediate layer 2a-2q, the openness of the layer 1a-1q relative to the first intermediate layer 2a-2q is reduced by the reinforced tying in of the longitudinal yarns into the uppermost yarn layer 1a-1q. Because the longitudinal yarns of the longitudinal yarn system 5a-5q run at about 50%, relative to its overall length, between the uppermost yarn layer 1a-1q and the first intermediate layer 2a-2q lying immediately thereunder, both layers form not only channels penetrating these layers in a perpendicular direction, but also a first flow channel system is created in the longitudinal direction of the belt between these two layers, which together form the cover layer of the drainage belt. The uppermost yarn layer 1a-1q and the first intermediate layer connected therewith by the first longitudinal yarn system 5a-5q have open space for water storage of about 50% of their volume. The integral permeability of both layers, measured by air passage at a negative pressure of 10 mm water column, is 1420 $l/m^2s$.

The yarn layer 3b-3q lying beneath the first intermediate layer 2a-2q, which layer 3b-3q can also be designated as the second intermediate layer, has 14 yarns per cm with diameters of 0.30 mm. The yarns of the lower yarn layer 4b-4q are arranged precisely below that of the second intermediate layer 3b-3q, so that the bottom yarn layer 4b-4q also has 14 yarns per cm. The fiber diameter here, however, is 0.35 mm. The second intermediate layer 3b-3q and the bottom yarn layer 4b-4q, which together form the support belt, are connected with each other by a second longitudinal yarn system 6A-6H, which has 35 longitudinal yarns per cm. The fiber diameter is 0.27 mm. The tying in of the yarns of the second intermediate layer 3b-3q, and those of the bottom yarn layer 4b-4q by means of the second longitudinal yarn system 6A-6H, as shown in the drawing, is performed in the same manner as with the uppermost yarn layer 1a-1q and the first intermediate layer 2a-2q. Here, too, the longitudinal yarn system 6A-6H ties reinforcingly into the second intermediate layer 3b-3q, which has the result that also in the support belt the webbing opens from the second intermediate layer toward the bottom yarn layer 4b-4q. The webbing portion of the drainage belt consisting of the second intermediate layer 3b-3q and the bottom yarn layer 4b-4q has an integral open screen space of 60% with an overall permeability of 2500 $l/m^2s$.

The hydraulic radius of the first intermediate layer 2a-2q is 1.12 fold, the hydraulic radius of the second intermediate layer 3b-3q is 1.96 fold and the hydraulic radius of the bottom yarn layer 4b-4q is 2.20 fold of the hydraulic radius of the uppermost yarn layer 1a-1q. Therefore, the channels penetrating the drainage belt in a perpendicular direction are equivalent to a funnel opening toward the underside of the belt.

The support belt is connected with the second intermediate layer 3b-3q by means of the second longitudinal yarn system 6A-6H as shown in FIGS. 1-3. Only one of sixteen successive yarns of layer 2a-2q is tied in by each yarn of yarn system 6A-6H.

Instead of such a connection all four yarn layers could be connected with each other by means of a third longitudinal yarn system having a lower yarn count. This third longitudinal yarn system could consist of twisted yarn having a diameter of 0.15 mm.

Figure 4:
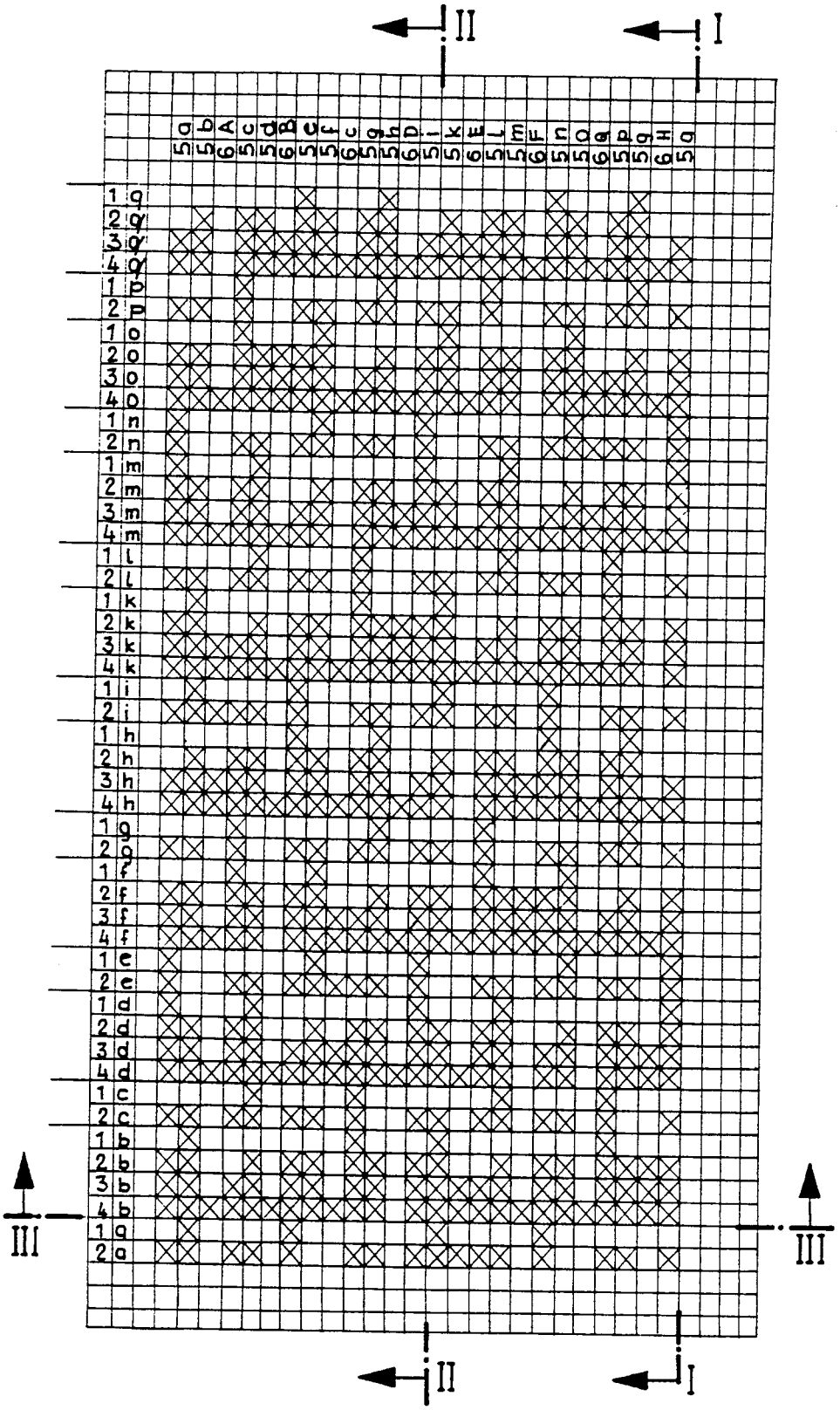
FIG. 4 is the pattern showing the relationship of the warp and weft yarns of the embodiment according to FIGS. 1-3.

For purposes of clarity, the drainage belt of the invention is shown in FIG. 1 disposed between the upper roll UR and lower roll LR of the press, as described hereinabove in the Background of the Invention. The pattern shown in FIG. 4 shows, for all yarns of one repeat crossing another yarn within this repeat, which yarn lies above the other at the intersection. A cross means that the longitudinal yarn lies above the crossed transverse yarn. In reading the pattern it is to be noted that all transverse yarns having the same reference character, for instance the character b, lie one above the other and not, as shown in the pattern, side by side.

The drainage belt formed in the above manner has an overall thickness of 1.6 mm. Of this, the uppermost yarn layer 1*a*–1*q* comprises about 0.25 mm, the first intermediate layer 2*a*–2*q* lying immediately thereunder comprises about 0.30 mm, the second intermediate layer 3*b*–3*q* comprises about 0.45 mm and the bottom yarn layer 4*b*–4*q* comprises about 0.6 mm. The openness of the drainage belt lies well above 50% and the drainage belt is nearly incompressible. As shown by FIGS. 1–3 the drainage belt is mono-plane or single-plane, i.e., the upper side of those parts of longitudinal yarns 5*a*–5*q* lying above the yarns of uppermost yarn layer 1*a*–1*q* lies in the plane defined by the uppermost yarn layer which contacts the paper web.

Figure 5:
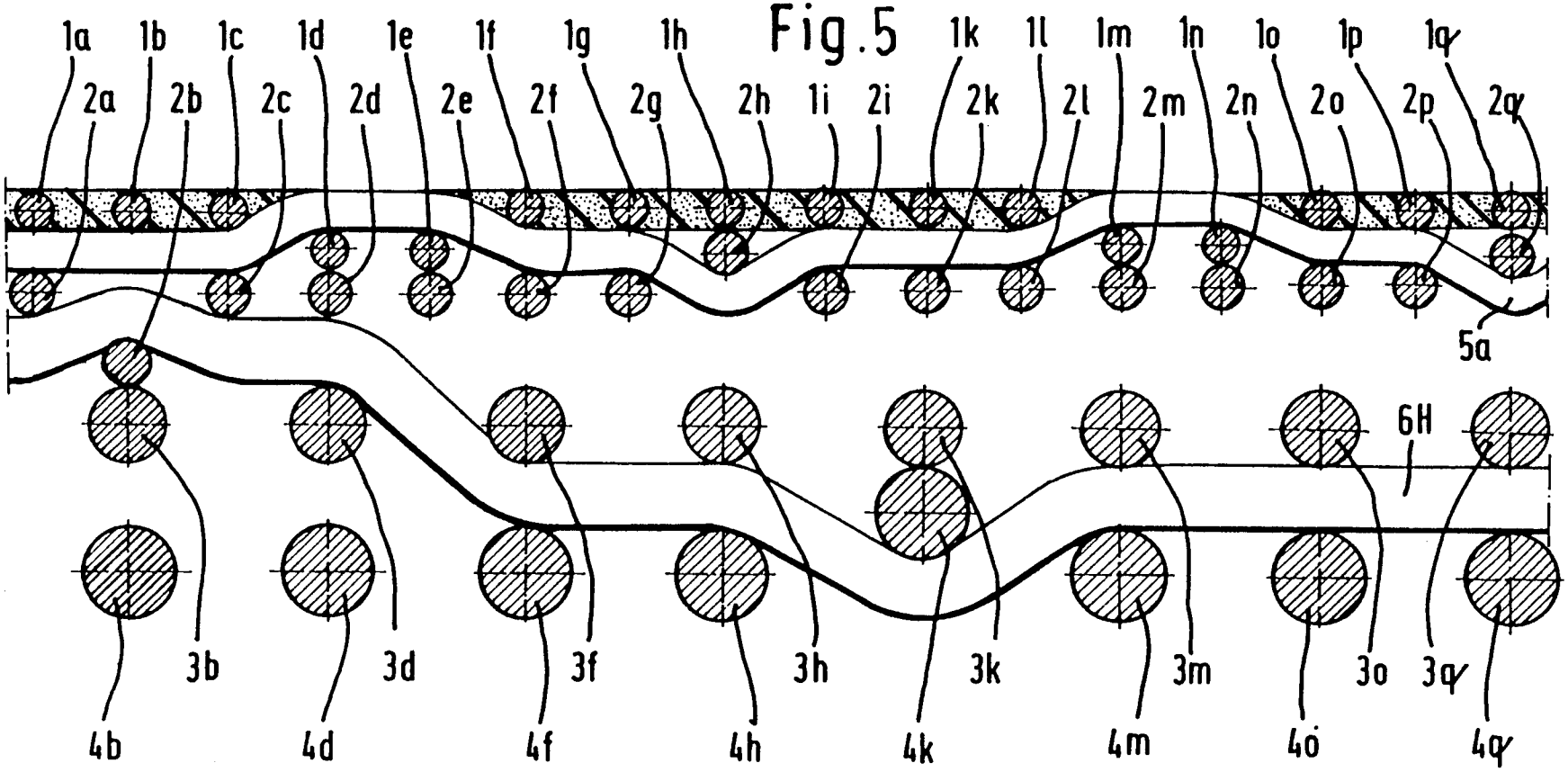
FIG. 5 is a longitudinal cross-section corresponding to FIG. 1 of a second embodiment.

The embodiment of FIG. 5 differs from the embodiment of FIGS. 1–4 only by an open-pore foam material which is provided between the yarns of the uppermost yarn layer 1*a*–1*q*. Of course this foam material reduces the hydraulic radius of layer 1*a*–1*q* so that the funnel effect is increased. Further the side of the drainage belt facing the paper web is smoother. However, on the other side by the foam material, there is a risk of obstruction whereas embodiments without foam material do not change their qualities.

Figure 6:
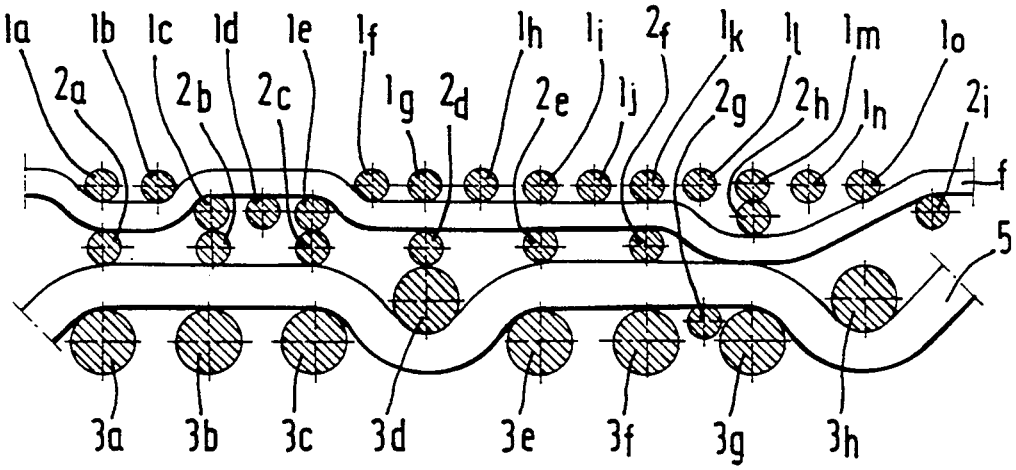
FIG. 6 is a longitudinal cross-section similar to FIG. 1 of an additional embodiment of the invention illustrating a drainage belt having three transverse yarn systems.

Referring now to FIG. 6, the drainage belt according to an additional embodiment is comprised of three layers or systems of yarns running in the transverse direction of the belt. These yarns are usually the wefts. The three systems or layers of yarns are disposed one above the other. In FIG. 6, with the belt lying in a horizontal plane, the yarns are vertically disposed with respect to one another. The uppermost layer, which comes into contact with the paper web, is designated with the numerals 1*a*–1*o*, the yarn layer lying intermediately beneath the first such layer is designated with the numerals 2*a*–2*i*, and the bottom yarn layer, which forms the running surface of the drainage belt, is designated with the numerals 3*a*–3*h*. The uppermost yarn layer 1*a*–1*o* has 32 yarns per centimeter, each having a diameter of 0.20 mm. The yarns of the intermediate layer 2*a*–2*i* has 16 yarns per centimeter, each having a diameter of 0.20 mm. The bottom or lower yarn layer 3*a*–3*h* has 16 yarns per centimeter, each yarn having a diameter of 0.40 mm.

Further, the three layers of weft yarns are tied together by two longitudinal yarn systems or warps, an upper warp layer 4 and a lower warp layer 5. Upper warp layer 4 has 65 yarns per centimeter, each having a diameter of 0.17 mm. Lower warp yarn layer 5 has 16 yarns per centimeter, each having a diameter of 0.27 mm. The warp and weft layers are tied in similarly to the manner described and illustrated for the embodiments of FIGS. 1–3, and a further description thereof is consequently omitted herein. All of the yarns in the embodiment of FIG. 6 are monofilament yarns.

Figure 7:
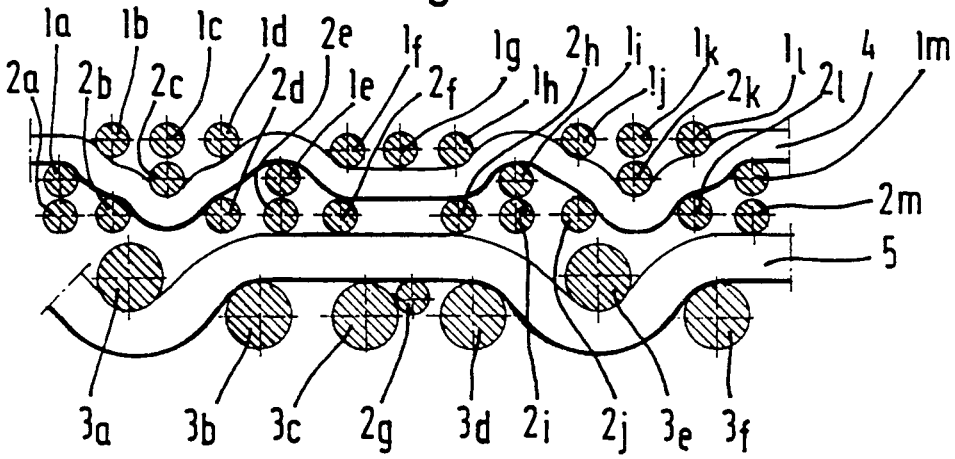
FIG. 7 is a longitudinal cross-section similar to FIG. 6 illustrating an additional embodiment of a belt having three transverse yarn systems.

Referring now to FIG. 7, the drainage belt according to an additional embodiment is comprised of three layers or systems of yarns running in the transverse direction of the belt. These yarns are usually the wefts. The three systems or layers of yarns are disposed one above the other. In FIG. 7, with the belt lying in a horizontal plane, the yarns are vertically disposed with respect to one another. The uppermost layer, which comes into contact with the paper web, is designated with the numerals 1*a*–1*m*, the yarn layer lying intermediately beneath the first such layer is designated with the numerals 2*a*–2*m*, and the bottom yarn layer, which forms the running surface of the drainage belt, is designated with the numerals 3*a*–3*f*. The uppermost yarn layer 1*a*–1*m* has 26 yarns per centimeter, each having a diameter of 0.20 mm. The yarns of the intermediate layer 2*a*–2*m* has 26 yarns per centimeter, each having a diameter of 0.20 mm. The bottom or lower yarn layer 3*a*–3*f* has 16 yarns per centimeter, each yarn having a diameter of 0.40 mm.

Further, the three layers of weft yarns are tied together by two longitudinal yarn systems or warps, an upper warp layer 4 and a lower warp layer 5. Upper warp layer 4 has 65 yarns per centimeter, each having a diameter of 0.17 mm. Lower warp yarn layer 5 has 16 yarns per centimeter, each having a diameter of 0.27 mm. The warp and weft layers are tied in similarly to the manner described and illustrated for the embodiments of FIGS. 1–3, and a further description thereof is consequently omitted herein. All of the yarns in the embodiment of FIG. 7 are monofilament yarns.

All characteristics mentioned in the above specification as well as those that can be obtained only from the drawing are components of the invention as further embodiments, even if they are not especially emphasized and particularly not mentioned in the claims.

What I claim is:

1. A paper-making machine drainage belt comprising:

a) a first layer of transverse yarns having a first diameter;

b) a second layer of transverse yarns having a second diameter;

c) a support layer of transverse yarns having a diameter larger than the first and second diameters;

d) a longitudinal yarn system interwoven with the first layer to form a single plane structure, and also interwoven with the second layer to create open spaces forming drainage channels in said drainage belt from said first layer to said support layer, wherein the drainage channels become progressively larger from said first layer to said support layer; and wherein said drainage channels are formed such that the permeability of the support layer for water and air is greater than that of the second layer and in that the permeability of second layer is greater than the first layer such that the relative permeabilities are equivalent to a funnel opening toward the underside of the support layer.

2. The drainage belt of claim 1 for use in a press in a wet press section of the paper-making machine, wherein the first layer of transverse yarns forms a shape-retaining cover layer.

3. The drainage belt according to claim 1, wherein said drainage channels are formed with an open volume selected such that the water absorption capacity is greater than a water quantity to be pressed out of a paper web by a nip of the press in said paper-making machine.

4. The drainage belt according to claim 1, wherein the single plane structure forms a screen having a significantly smaller thickness than that of the support layer.

5. The drainage belt according to claim 1, wherein the single plane structure is formed of a screen webbing having a woven construction and comprises monofilament yarns.

6. The drainage belt according to claim 1, wherein the transverse yarns form first and second yarn systems which lie precisely above one another at least in the first layer and are interlaced with the longitudinal yarns of the longitudinal yarn system from above.

7. The drainage belt according to claim 1, wherein the transverse yarns form first and second yarn systems which lie precisely above one another at least in the first layer and are interlaced with the longitudinal yarns of the longitudinal yarn system from beneath.

8. The drainage belt according to claim 1, wherein the first layer and the support layer are woven together.

9. The drainage belt according to claim 1, wherein the compressibility of the first layer is slightly higher than that of the support layer.

10. The drainage belt according to claim 1, wherein said drainage belt is nearly incompressible.

11. The drainage belt according to claim 1, wherein the support belt is made of monofilament plastic yarns.

12. The drainage belt according to claim 1, wherein the number of drainage channels in the first layer is greater than in the support layer.

13. The drainage belt according to claim 2, wherein said drainage channels are formed with an open volume selected such that the water absorption capacity is grater than a water quantity to be pressed out of a paper web by a nip of the press in said paper-making machine.

14. The drainage belt according to claim 2, wherein the single plane structure forms a screen having a significantly smaller thickness than that of the support layer.

15. The drainage belt according to claim 2, wherein the single plane structure is formed of a screen webbing having a woven construction and comprises monofilament yarns.

16. The drainage belt according to claim 2, wherein the transverse yarns form first and second yarn systems in which lie precisely above one another at least in the first layer and are interlaced with the longitudinal yarns of the longitudinal yarn system from above.

17. The drainage belt according to claim 2, wherein the transverse yarns form first and second yarn systems which lie precisely above one another at least in the first layer and are interlaced with the longitudinal yarns of the longitudinal yarn system from beneath.

18. The drainage belt according to claim 2, wherein the first layer and the support layer are woven together.

19. The drainage belt according to claim 2, wherein the compressibility of the first layer is slightly higher than that of the support layer.

20. The drainage belt according to claim 2, wherein said drainage belt is nearly incompressible.

21. The drainage belt according to claim 2, wherein the support belt is made of monofilament plastic yarns.

22. The drainage belt according to claim 2, wherein the number of drainage channels in the first layer is greater than in the support layer.

* * * * *